United States Patent [19]

Sato et al.

[11] Patent Number: 4,984,443

[45] Date of Patent: Jan. 15, 1991

[54] PLASTIC WORKING METHOD AND APPARATUS

[75] Inventors: Takeaki Sato, Kasugai; Yoshihiro Kozaki, Inuyama; Kunio Hirota, Aichi, all of Japan

[73] Assignee: Brother Kogyo Kabushiki Kaisha, Aichi, Japan

[21] Appl. No.: 436,032

[22] Filed: Nov. 14, 1989

[30] Foreign Application Priority Data

Nov. 18, 1988 [JP] Japan ..... 63-293194

[51] Int. Cl.[5] ..... B21J 13/02

[52] U.S. Cl. ..... 72/67; 72/406

[58] Field of Search ..... 72/67, 74, 115, 125, 72/406

[56] References Cited

U.S. PATENT DOCUMENTS

| | | |
|---|---|---|
| 3,583,192 | 6/1971 | Kocks . |
| 3,990,285 | 11/1976 | Dragoun . |
| 3,990,286 | 11/1976 | Cremonesi . |
| 4,069,698 | 1/1978 | Dragoun . |
| 4,391,121 | 7/1983 | Taruntaev . |
| 4,698,992 | 10/1987 | Bernet . |

FOREIGN PATENT DOCUMENTS

| | | |
|---|---|---|
| 238186 | 9/1987 | European Pat. Off. . |
| 3510250 | 10/1985 | Fed. Rep. of Germany . |
| 3539924 | 5/1987 | Fed. Rep. of Germany . |
| 60-227939 | 11/1985 | Japan . |
| 517514 | 6/1976 | U.S.S.R. . |
| 608590 | 5/1978 | U.S.S.R. . |
| 941003 | 7/1982 | U.S.S.R. . |
| 1061905 | 12/1983 | U.S.S.R. . |
| 319065 | 3/1929 | United Kingdom . |
| 1205171 | 9/1970 | United Kingdom . |
| 1224259 | 3/1971 | United Kingdom . |
| 1224260 | 3/1971 | United Kingdom . |

*Primary Examiner*—Lowell A. Larson

*Attorney, Agent, or Firm*—Oliff & Berridge

[57] ABSTRACT

A plastic working method and apparatus which performs swiveling motion of an upper die mounted on a die holder. A toggle mechanism is provided for power assisting function. The toggle mechanism includes a link and the die holder. Upper and lower end portion of the die holder are movably supported by upper and lower double eccentric rotary mechanisms for changing orientation of the die holder. The link is disposed within the die holder and has upper end supported by a machine frame and a lower end supported by the die holder. Orientation of the link is also changeable.

11 Claims, 4 Drawing Sheets

PLASTIC WORKING METHOD AND APPARATUS

BACKGROUND OF THE INVENTION

The present invention relates to a plastic working method and an apparatus therefor, and more particularly to a method and an apparatus wherein a swivel motion of a die and a reciprocating motion of the die against a workpiece are combined with each other to thereby further increase fluidity of material of the workpiece to thus enhance the filing property of the material to the die.

In a so-called rotary forging in which a upper die having a predetermined inclination angle relative to a workpiece is swiveled to perform a plastic working, only one of a swivel motion at a predetermined inclination angle and a swing motion in a predetermined inclination angle range has been conventionally applied to the upper die.

Not only in a rotary forging work but also a general forging work, it is very important to enhance fluidity of material of the workpiece and to enhance the filing rate of the material into the lower die supporting the workpiece thereon.

However, in the conventional rotary forging work, since only the plastic working is performed to the workpiece by the swivel motion at the predetermined inclination angle or by the swing motion in the predetermined inclination angle range as described above, although the material of the workpiece is spread in a flat manner, the filing of the material into the lower die is not satisfactory. In particular, in a case of forging a workpiece so as to provide a projection in the middle or intermediate portion of the final product, there is a problem that the filing of the material would be insufficient and a material lacking or insufficient spreading may locally occur. Incidentally, a commonly assigned copending U.S. Pat. Application Ser. No. 07/227,301 has been filed on Aug. 2, 1988 (corresponding to European Patent Application No. 88307331.4 filed on Aug. 8, 1988).

SUMMARY OF THE INVENTION

In order to overcome the above-noted defects, an object of the invention is to provide a plastic working method and a plastic working apparatus in which the swivel motion of the die and the reciprocating motion of the die to the workpiece are composited to enhance the fluidity of material of the workpiece to thereby perform an exact plastic work in conformity with the die shape.

In order to attain this object, there is provided a plastic working method with using a swivel type plastic working apparatus wherein a machine frame is provided and a upper die mounted on a die holder is pressed against a workpiece on a lower die while swiveling the die holder, the die holder having an inclination axis intersecting with a vertical axis in the vicinity of a forging portion, and being swiveled about the vertical axis to thereby applying a plastic work to the workpiece, the plastic working method comprising the steps of: providing a single press link between the holder and the machine frame with one end of the press link being engaged rotatably about a point on the vertical axis relative to the machine frame and with the other end of the press link being engaged rotatably about a point on the inclination axis relative to the die holder; disposing the die holder movable in a predetermined range in vertical direction along the vertical axis: changing the inclination angle of the inclination axis relative to the vertical axis during the working; and imparting a reciprocating motion to the upper die mounted on the die holder within a minute range in the direction of the vertical axis by the change in the inclination angle and the provision of the press link.

Also, a plastic working apparatus which reduces the plastic machining method to practice includes a frame, a first die having a shaping face, and a second die confronting the first die for mounting thereon a workpiece, the workpiece being depressed by co-operation of the first and second die, thereby applying a plastic work to the workpiece. The improvement comprises; a die holder means having one end connected to the first die; a link means rotatably and inclinably provided between the die holder means and the frame; moving means for providing swiveling motion to the die holder means; and changing means for changing an inclination angle of the die holder means.

In one embodiment of this invention, a plastic working apparatus comprises a machine frame composed of an upper machine frame and a lower machine frame which are formed in a one piece, the machine frame defining a vertical axis CL and the upper machine frame having an upper portion; a first drive motor; a first rotary member supported to the upper portion of the upper machine frame and rotatable about the vertical axis, the first rotary member being formed with a first eccentric hole eccentric with respect to its rotary axis by a predetermined offset, and drivingly rotated by the first drive motor; a second drive motor; a second rotary member rotatably engaged with the first eccentric hole, the second rotary member being formed with a second eccentric hole eccentric with respect to its rotary axis by substantially the same offset as that of the first rotary member, and drivingly rotated by the second drive motor; a first bearing member engaged with the second eccentric hole so as to be rotatable and movable in the axial direction, the first bearing member being formed with a first spherical bearing hole whose center is positioned on a rotary axis of the first bearing member; a second bearing member supported directly or indirectly below the upper machine frame so that the second bearing member may rotate about the vertical axis or an axis in parallel with the vertical axis and may move in the axial direction in a predetermined range, the second bearing member being formed with a second spherical bearing hole whose center is positioned on a rotary axis of the second bearing member; an upper holder having a first spherical shaft portion and a second spherical shaft portion engaged with the first and second spherical bearing holes, respectively, the upper holder having a recess directed downwardly at a central portion of the first spherical shaft portion, and provided with a upper die in the vicinity of a center of the second spherical shaft portion within the second spherical shaft portion; a press link having one end rotatable about a point on the vertical axis and engageable with the upper machine frame, and having another end rotatable about a point on an axis connecting between centers of the first and second spherical shaft portions and engageable with the upper die holder within the recess thereof; a lower die support member having a lower die on which a workpiece is mounted in confronted relation with the upper die, the support member being supported reciprocally in the direction of the vertical axis by the lower machine frame; a lower die drive means for imparting the reciprocating motion to the lower die support member; and control means operably connected to the first and second drive motors and the lower die drive means for controlling these drive motors and the drive means, the control being made in accordance with data inputted in advance into the control means, to thereby generate a relative movement of the first and second rotary members during the forging work, whereby an angle defined by the axis of the die holder, that is, the line connecting the centers of the first and second spherical shaft portions and the vertical axis is changed so that a reciprocating motion may be applied in a minute range in the vertical axis direction to the upper die because of the angle change and the provision of the press link.

According to the above-described plastic working method and apparatus, the rotations of the outer and inner rotary members of the double-eccentric rotary mechanism are controlled in accordance with predetermined control modes, respectively. When the eccentric position of the inner rotary member supporting rotatably and obliquely movably the proximal end of the die holder is changed relative to the center axis, the swivel inclination angle of the die holder is changed corresponding to the change in eccentricity, so that the die mounting portion of the die holder is reciprocated in the axial direction of the center axis. Since the outer side of the die mounting portion at the distal end of the die holder is supported rotatably and obliquely movable to the machine frame, and the holder is supported rotatably and obliquely movable to one end of the link with the other end being rotatably and obliquely movably supported to the apparatus body for positioning the holder, a toggle mechanism is composed of three members, i.e., the machine frame, the link and the die holder. Accordingly, when the swivel inclination angle of the die holder is changed to a small level and the die holder and the link are close to the vertical position, a large pressure applied to the workpiece supported to the workpiece support surface is generated in the die mounted on the die holder by the toggle effect, to thereby press the workpiece in the direction of the center axis.

DETAILED DESCRIPTION OF THE PREFERRED EMBODIMENT

An embodiment of the invention will now be described with reference to the accompanying drawings.

Figure 1:
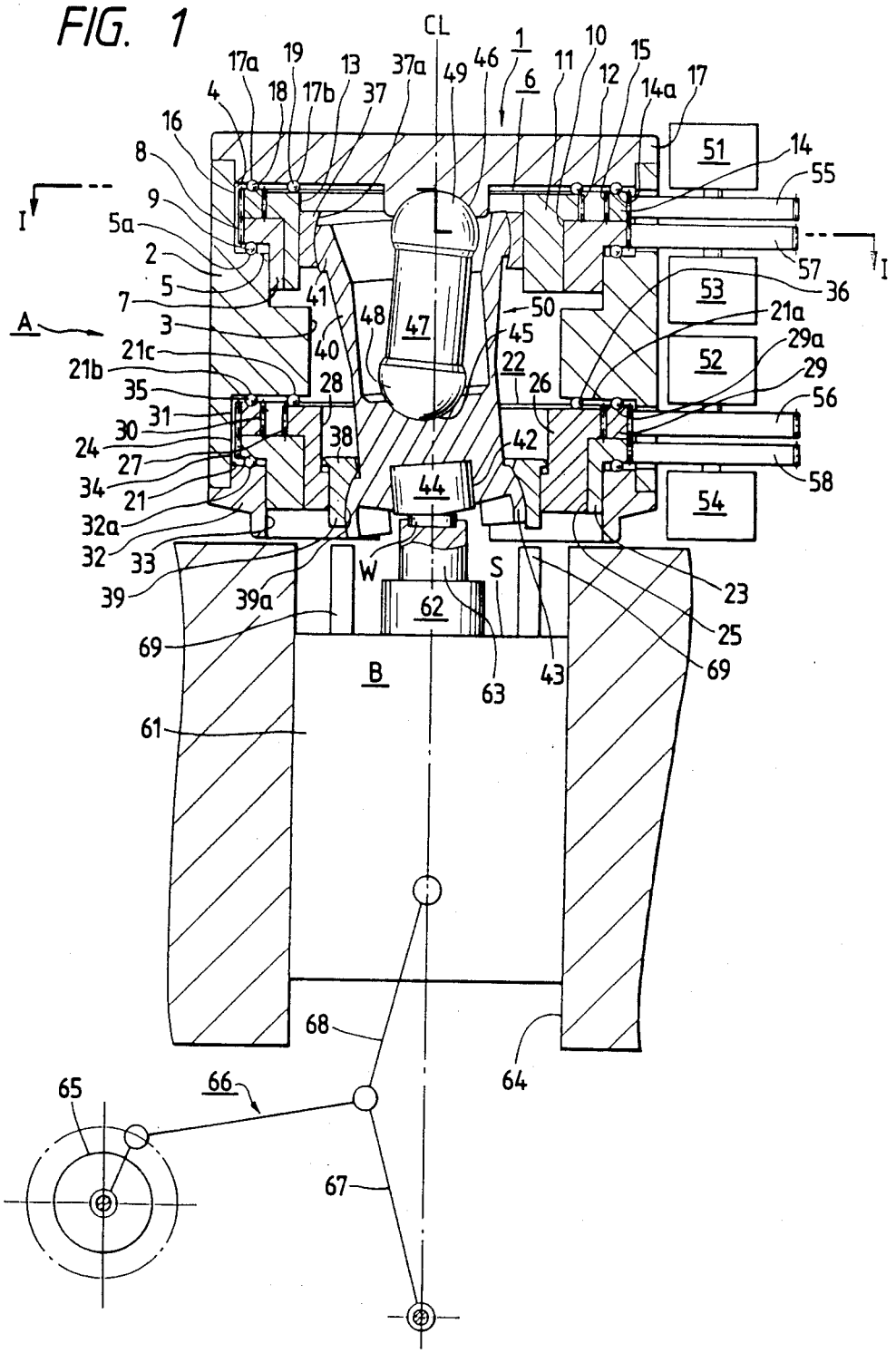
FIG. 1 is a cross-sectional view showing an overall arrangement of the apparatus according to the invention.
Figure 2:
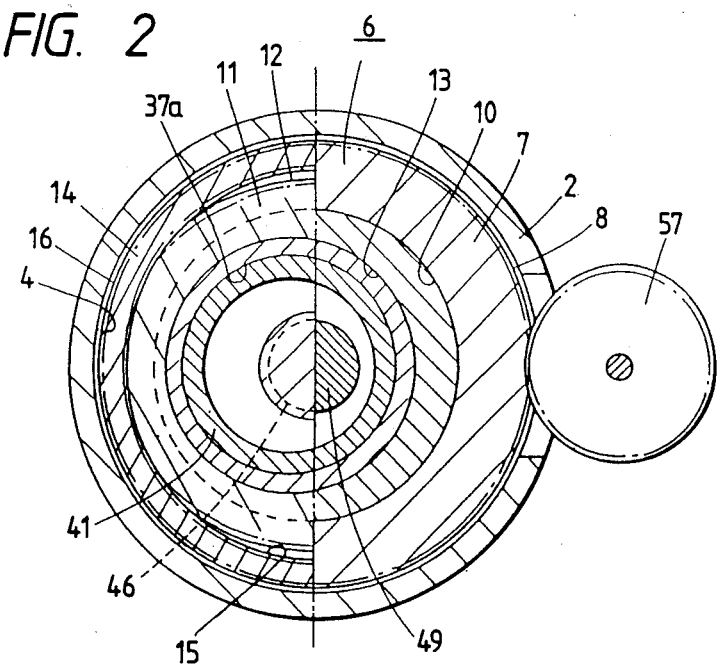
FIG. 2 is a cross-sectional view taken along the line I—I of FIG. 1.

FIG. 1 is a cross sectional view showing an overall arrangement of a rotary forging machine, i.e., a plastic-forging apparatus according to the invention.

A rotary forging machine 1 is composed of a swiveling drive section A for swiveling a upper die and a vertically movable support section B for supporting a lower die that is movable up and down. The respective sections are arranged in confronted relation with each other and disposed coaxially with respect to a common center axis CL.

An insertion hole 4 having a larger diameter than a center hole 3 is formed at an upper end portion of a cylindrical casing 2 of the upper die swiveling drive section A (hereinafter referred to as a body drive section). A double-eccentric rotary mechanism 6 is rotatably mounted within the insertion hole 4. A gear 8 is formed on an outer periphery of an outer rotary member 7 of the double-eccentric rotary mechanism 6 inserted into the insertion hole 4, and the rotary member 7 is supported by a spherical connection chain 9 engaged with an annular groove 5*a* of a large diameter stepped portion 5 of the insertion hole 4.

An inner rotary member 11 is rotatably inserted into an eccentric hole 10 formed in the outer rotary member 7. A gear 12 is formed on an outer circumferential wall of the inner rotary member 11, and an eccentric hole 13 that has the same eccentricity as that of the eccentric hole 10 relative to its own rotary center is formed in the inner rotary member 11. Further, a ring-shaped gear 14 is disposed on a top surface of the outer rotary member 7 with an inward gear 15 of the ring-shaped gear 14 being engaged with the gear 12 of the inner rotary member 11. The number of a outward gear teeth 16 formed on an outer peripheral wall of the ring-shaped gear 14 and an outer diameter thereof are the same as the tooth number and the diameter of the gear 8 formed on the outer rotary member 7, respectively.

At an upper open portion of the cylindrical casing 2, there is formed a spherical connection chain 18 covered by an upper lid 17 fixed to the casing 21 and clamped and engaged by annular grooves 17*a* and 14*a* formed in confronted relation with each other on a circle having a common diameter and a common center between the upper lid 17 and the ring-shaped gear 14 for smooth rotation of the ring-shaped gear 14 and for preventing the radial movement of the ring-shaped gear 14. A spherical connection chain 19 engaged with an annular groove 17*b* formed in the upper lid 17 is in contact with the top surface of the inner rotary member 11.

At the lower end portion of the cylindrical casing 2, there is formed a hole 21 having a larger diameter as that of the center hole 3 in the same manner, to form a double-eccentric rotary mechanism 22.

The double-eccentric rotary mechanism 22 has the same structure as that of the first-mentioned double-eccentric rotary mechanism 6. A gear 24 is formed on an outer wall of an outer rotary member 23 with an eccentric hole 25. An inner rotary member 26 is rotatably inserted into the eccentric hole 25. A gear 27 is formed on an outer circumferential wall of the inner rotary member 26 with an eccentric hole 28 having the same eccentricity as that of the eccentric hole 25 relative to its own rotary center.

A ring-shaped gear 29 is disposed on a top surface of the outer rotary member 23 with an inner teeth 30 of the ring-shaped ring gear 29 being engaged with the gear 27 of the inner rotary member 266. The number of outward teeth 31 of the ring-shaped gear 29 and an outer diameter thereof are the same as the tooth number and an outer diameter of the gear 24 of the outer rotary member 23, respectively.

A lower lid 32 is used to surround a lower open end portion of the cylindrical casing 2. The outer rotary member 23 of the double-eccentric rotary mechanism 22 is inserted into an insertion hole 33 formed in the lower lid 32. A portion of the gear 24 of the outer rotary member 23 is supported by a spherical connection chain 34 inserted into an annular groove 32*a* formed in the top surface of the lower lid 32. Annular grooves 21*b* and 29*a* having the common center and the common center are formed in a large diameter stepped portion 21*a* of the large diameter hole 21 and the ring-shaped gear 29, respectively for smooth rotation due to the spherical connection chain 35 engaged with the grooves and for preventing the radial movement of the ring-shaped gear 29. Further, a spherical connection chain 367 engaged with an annular groove 21*c* formed in the large diameter stepped portion 21*a* is in contact with the inner rotary member 26.

A bearing 37 is slidably mounted in the eccentric hole 13 of the inner rotary member 11 of the double-eccentric rotary mechanism 6 supported in the cylindrical casing 2 with a spherical surface 37*a* in the inner bearing portion. A slider 38 slidable up and down along the center axis CL is engaged with an eccentric hole 28 formed in the inner rotary member 26 of the lower double-eccentric rotary mechanism 22. A bearing portion formed in an inner surface of a bearing 39 formed in the slider 38 is formed in a spherical recess 39*a*.

A spherical shaft portion 41 of an upper end of a upper holder 40 is rotatably and obliquely movably supported by the spherical recess 37*a* of the bearing 37. A spherical shaft portion 43 formed in an outer circumferential wall of a lower die mounting portion 42 is rotatably or obliquely movably supported by the spherical recess 39*a* formed in the bearing 39. A upper die 44 having a desired shape is fixedly secured to the die mounting portion 42 of the upper holder 40.

The upper die holder 40 has a cylindrical shape at its upper half portion and a spherical recess 45 at its bottom portion. Also, a recess 46 is formed in an inner central portion of the upper lid 17 in the same manner. Spherical shaft portions 48 and 49 mounted on both ends of a pressurizing link member 47 are rotatably and obliquely movably supported between the two spherical recesses 45 and 46. With this arrangement, the upper portions of the pressurizing link member 47 and the upper die holder 40 are positioned by the fixed spherical recess 37*a* and the spherical recess 46 of the upper lid 17. The lower end portion of the upper die holder 40 is slidably supported. Thus, it is possible to form a toggle mechanism 50 where the upper die holder 40 and the pressurizing link member 47 are held in vertical positions by reducing the slant angle of the upper die holder 40 to thereby produce a large force downwardly.

Drive gears 55 to 58 which are driven by respective drive motors 51 to 54 are engaged with the ring-shaped gears 14 and 29 of the two double-eccentric rotary mechanisms 6 and 22 and the gears 8 and 24 formed on the outer circumferential walls of the outer rotary members 7 and 23. In the double-eccentric rotary mechanism 22, the slider 38 for rotatably and obliquely movably supporting the outer side of the die mounting portion of the upper die holder 40 is supported by the inner eccentric rotary member 26. The rotations of the outer and inner rotary members 23 and 26 are individually controlled by drive motors 52 and 54.

The lower die support section B is arranged below the body drive apparatus A so that the center axes CL of the respective sections are on a common line in confronted relation between the sections. A die mounting portion 62 is mounted on a top surface of a lower die support base 61 which serves as a workpiece support surface S substantially perpendicular to the common center axis CL. A lower die 63 is mounted thereon. A workpiece W is supported within the lower die 63. A lower die support base 61 is inserted into a guide hole 64 formed in the direction of the center axis CL and is moved up and down by a link 68 connected to a lever 67 of a lever crank mechanism 66 driven by a drive motor 65. A control of a position of the lower die 63 relative to the upper die 44 is performed by controlling the drive of the drive motor 65 in accordance with a detection signal of a position detecting sensor 69 arranged on the top surface of the lower die support base 61. Any type of an access sensor may be used as the position detecting sensor 69.

Figure 3:
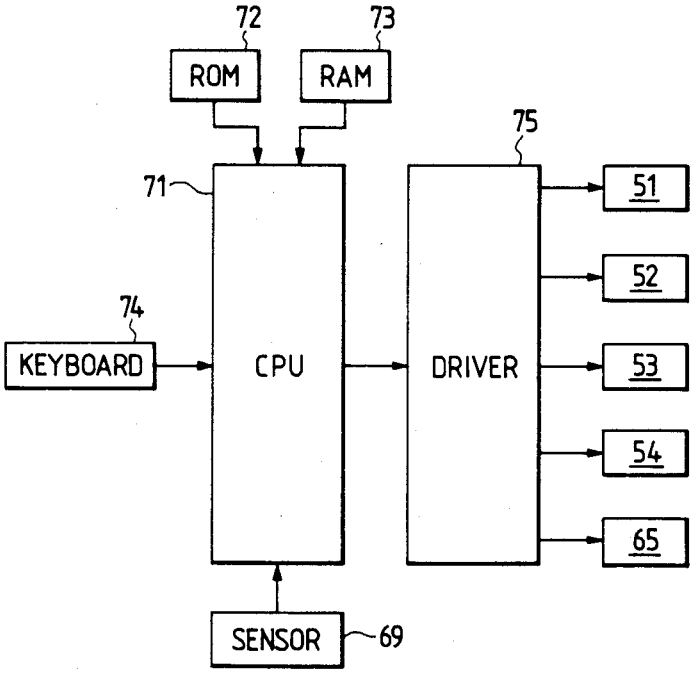
FIG. 3 is a schematic control circuit diagram.

A schematic control circuit of the rotary forging machine 1 according to this embodiment is shown in FIG. 3.

A central processing unit (hereinafter referred to as CPU) 71 is provided with a program memory (ROM) 72 and an operational memory (RAM) 73. Into the program memory (ROM) 72, there is stored various control modes for achieving the adjustment of the up-and-down relative position of the upper and lower dies 44 and 63 and the eccentricities of the outer and inner rotary members 7, 11 and 23, 26 of the double-eccentric rotary mechanism 6 and 22 and for achieving the rotary control thereof to perform a desired plastic working. An operational panel 74 for assigning the data inputs or the control modes and the position detecting sensor 69 are connected to the CPU 71. Further, connected to CPU through a motor driver 75 are the drive motors 51 to 54 for driving the respective drive gears 55 to 58 engaged with the respective gears of the double-eccentric rotary mechanisms 6 and 22 and the drive motor 65 for driving the lever crank mechanism 66.

The operation of the thus structured rotary forging machine 1 will now be described.

The rotations of the outer rotary member 7 and the inner rotary member 11 of the double-eccentric rotary mechanism 6 in the body drive section A are independently controlled by the drive motors 51 and 53 driven in accordance with the commands of the motor driver 75 receiving the control signals of CPU 71. Accordingly, it is possible to swivel the upper die holder 40 by setting a constant eccentricity by the selection of the desired control mode, that is, at a constant inclined angle. It is also possible to continuously change the eccentricity, set together with the swivel drive, in a predetermined range as desired. It is also possible to swing the upper die holder 40 at a predetermined swing angle within a plain passing through the center axis CL if the outer and inner rotary members 7 and 11 are synchronously rotated in the opposite direction at the same speed.

Also, in the double-eccentric rotary mechanism 22, the slider 38 is adapted for rotatably and obliquely movably supporting the outer side of the die mounting portion of the upper die holder 40, and the slider 38 is supported by the inner eccentric rotary member 26. Therefore, the rotations of the outer and inner rotary members 23 and 26 are individually controlled by drive motors 52 and 54, so that the eccentricity is adjusted in a predetermined range as desired and the swivel center of the upper die 44 swiveling in contact with the workpiece W may be moved.

On the other hand, with respect to the lower die support section B, the lever crank mechanism 66 is driven by the drive motor 65, and the lower die support base 61 is stopped at a predetermined position within the guide hole 64 in accordance with the detection signal of the position detecting sensor 69 to bring the workpiece W supported within the lower die 63 into contact with the upper die 44 under a constant pressure. Alternatively, by the continuous drive of the lover crank mechanism 66, the lower die support base 61 is raised in a predetermined plastic working period to thereby gradually increase the contact pressure of the lower die 63 against the upper die 44.

Figure 4:
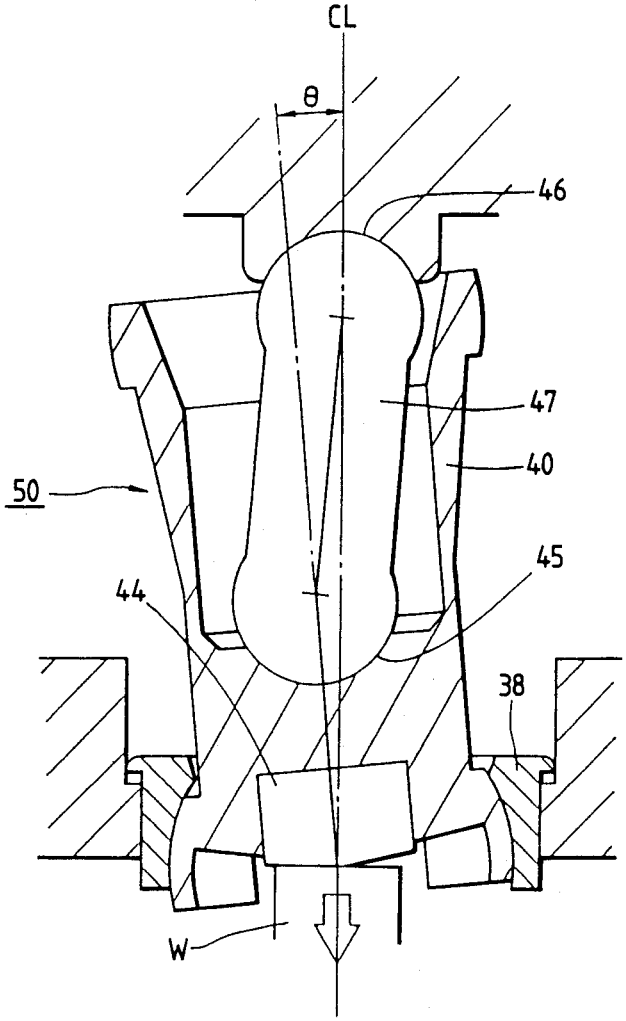
FIG. 4 is a cross-sectional illustration particularly showing the toggle effect.
Figure 5A:
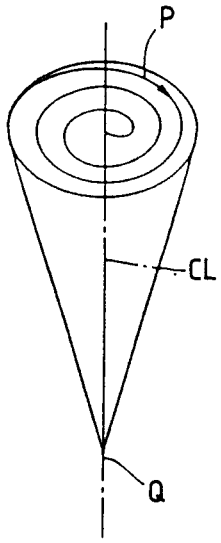
FIGS. 5(*a*) through 5(*e*) are schematic illustrations for descriptions of various operational modes of the upper die holder according to the present invention.
Figure 5B:
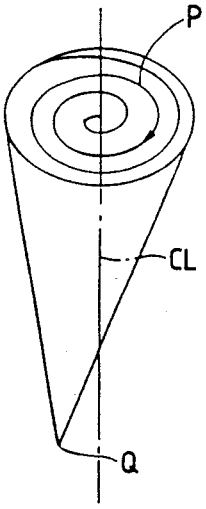
Figure 5C:
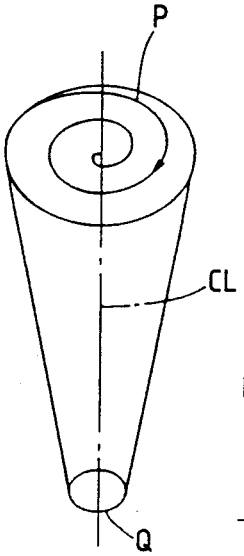
Figure 5D:
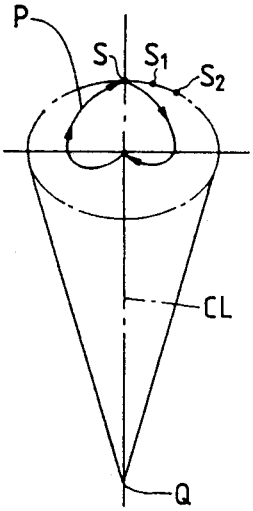
Figure 5E:
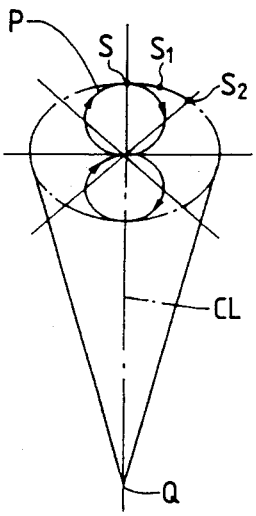

By the cooperation between the body drive section A and the lower die support section B, the rotary forging where the upper die 44 is swiveled about a swivel center on the workpiece W is performed, and at the same time, the eccentricity of the double-eccentric rotary mechanism 6 relative to the center axis CL may be changed to decrease the swivel inclined angle 0 of the upper holder 40. As a result, the upper holder 40 and the press link member 47 are close to their vertical positions, so that as shown in FIG. 4, a large pressure may be applied to the upper die swiveling in contact with the workpiece W by the toggle mechanism 50 composed of the upper holder 40, the press link member 47 and the slider 38.

The plastic working operational modes of the upper die holder 40 in which the pressure is applied to the workpiece W simultaneously with the rotary forging are classified into modes shown in, for example, FIGS. 5(*a*) to 5(*c*) where the change in eccentricity relative to the swivel speed is small and modes shown in for example, FIGS. 5(*d*) to 5(*e*) where the change is large.

In these figures, P denotes an eccentric rotational path of the upper end of the upper die holder 40, and Q denotes a rotational path of a swivel center of the upper die 44 mounted on the upper die holder 40.

FIG. 5(*a*) shows a mode wherein the rotations of the outer and inner rotary members 7 and 11 of the double-eccentric rotary mechanism 6 are controlled respectively with the swivel center Q being identical with the center axis CL, whereby the swivel inclination angle of the upper die holder 40 relative to the center axis CL is gradually decreased in accordance with the swiveling operation. In this case, the rotational path P is spiral from the outer circumference to the center. By the gradual decrease of the swivel inclinational angle, the pressure of the upper die 44 against the workpiece W is gradually increased.

FIG. 5(*b*) shows a mode wherein, in the case shown in FIG. 5(*a*), the eccentricity of the double-eccentric rotary mechanism 22 is adjusted so that the swivel center Q is offset from the center axis CL. In this case, it is possible to gradually increase the pressure by the gradual decrease of the swivel inclination angle.

FIG. 5(*c*) shows a mode wherein, in the case shown in FIG. 5(*b*), the swivel motion is attained while holding a constant eccentricity with the swivel center Q.

FIG. 5(*d*) shows a mode wherein the eccentricity is abruptly changed so that the eccentricity is $\frac{1}{2}$ in the first $\frac{1}{4}$ swivel rotation and the eccentricity is zero in the subsequent $\frac{1}{4}$ swivel rotation. The pressure applied to the workpiece W is abruptly increased in the initial $\frac{1}{2}$ swivel rotation. Accordingly, since the region to which the pressure is applied is non-uniform, the swivel start position S is moved in order such as S1 and S2 to thereby apply the pressure uniformly over the workpiece W.

FIG. 5(*e*) shows a mode wherein the rate of change in eccentricity is twice larger than that in the foregoing case. In this case, the eccentricity is changed to zero in the initial $\frac{1}{4}$ swivel rotation. The pressure effect is increased during the initial $\frac{1}{4}$ swivel rotation and 2/4 to $\frac{3}{4}$ swivel rotation. Also, in this case, the swivel start position S is moved in order so that the pressure is applied uniformly over the workpiece W. Further, swinging motion of the upper die holder 40 with respect to the center line CL thereof can be provided by controlling rotations of the outer and inner rotary members 7 and 11 of the double-eccentric rotary mechanism 6.

It is thus possible to adjust, as desired, the relationship between the change of eccentricity (change in swivel inclination angle 0) and the swiveling speed by individually controlling the rotations of the outer and inner rotary members 7 and 11 of the double-eccentric rotary mechanism 6. Accordingly, it is possible to gradually increase the pressure or to abruptly increase the pressure as desired.

As has been described, by decreasing the swivel inclination angle of the upper die holder 40 simultaneously with the rotary forging, it is possible to apply the pressure to the workpiece W. The material of the workpiece W is pressingly gathered toward the center, the filing rate in the lower die may be enhanced, and it is possible to work a product exactly in conformity with the die shape with a high material raising rate without any material loss.

It should be noted that the eccentricities of the outer and inner rotary members 7 and 11 of the double-eccentric rotary mechanism 6 are not necessarily identical with each other since the rotations of the rotary members are controlled individually.

According to the method of the invention, the swivel inclination angle of the working die swiveling at a predetermined slant angle relative to the axis passing through the swivel center on the workpiece as described above is changed, to thereby apply a reciprocating motion along the axis to the die to perform the plastic working. By applying the pressure to the workpiece, the material of the workpiece is gathered toward the center, the material raising rate is increased to thereby enhance the fluidity and filing property. Even in case of a complicated shape such as a gear having a boss in the middle, it is possible to work the product without any material loss.

As set forth in the description of the specific structure and the effect, in the apparatus according to the invention, the swivel inclination angle is changed by the change in eccentricity of the double eccentric rotary mechanism relative to the center axis to thereby apply the reciprocation motion to the die. At the same time, the eccentricity is changed close to zero by the toggle effect of the toggle mechanism composed of the machine body, the upper die holder and the linkage. When the upper die holder and the link are held in the vertical position, the large pressure is generated, thereby extremely effectively performing the plastic working method.

While the invention has been described in detail and with reference to specific embodiment thereof, it would be apparent to those skilled in the art that various changes and modifications can be made therein without departing from the spirit and scope of the invention.

What is claimed is:

1. A plastic working method with using a swivel type plastic working apparatus wherein a machine frame is provided and an upper die mounted on a die holder is pressed against a workpiece W on a lower die while swiveling the die holder, the die holder having an inclination axis intersecting with a vertical axis in the vicinity of a forging portion, and being swiveled about the vertical axis to thereby applying a plastic work to the workpiece, the plastic working method comprising the steps of:

providing a press link between the holder and the machine frame with one end of the press link being engaged rotatably about a point on the vertical axis relative to the machine frame and with the other end of the press link being engaged rotatably about a point on the inclination axis relative to the die holder;

disposing the die holder movable in a predetermined range in vertical direction along the vertical axis:

changing the inclination angle of the inclination axis relative to the vertical axis during the working; and imparting a reciprocating motion to the upper die mounted on the die holder within a minute range in the direction of the vertical axis by the change in the inclination angle and the provision of the press link.

2. A plastic working apparatus comprising:

a machine frame composed of an upper machine frame and a lower machine frame which are formed in a one piece, the machine frame defining a vertical axis and the upper machine frame having an upper portion;

a first drive motor;

a first rotary member supported to the upper portion of the upper machine frame and rotatable about the vertical axis, the first rotary member being formed with a first eccentric hole eccentric with respect to its rotary axis by a predetermined offset, and drivingly rotated by the first drive motor;

a second drive motor;

a second rotary member rotatably engaged with the first eccentric hole, the second rotary member being formed with a second eccentric hole eccentric with respect to its rotary axis by substantially the same offset as that of the first rotary member, and drivingly rotated by the second drive motor;

a first bearing member engaged with the second eccentric hole so as to be rotatable and movable in the axial direction, the first bearing member being formed with a first spherical bearing hole whose center is positioned on a rotary axis of the first bearing member;

a second bearing member, supported directly or indirectly below the upper machine frame so that the second bearing member may rotate about the vertical axis or an axis in parallel with the vertical axis and may move in the axial direction in a predetermined range, the second bearing member being formed with a second spherical bearing hole whose center is positioned on a rotary axis of the second bearing member;

an upper holder having a first spherical shaft portion and a second spherical shaft portion engaged with the first and second spherical bearing holes, respectively, the upper holder having a recess directed downwardly at a central portion of the first spherical shaft portion, and provided with a upper die in the vicinity of a center of the second spherical shaft portion within the second spherical shaft portion;

a press link having one end rotatable about a point on the vertical axis and engageable with the upper machine frame, and having another end rotatable about a point on an axis connecting between centers of the first and second spherical shaft portions and engageable with the upper die holder within the recess thereof;

a lower die support member having a lower die on which a workpiece is mounted in confronted relation with the upper die, the support member being supported reciprocally in the direction of the vertical axis by the lower machine frame;

a lower die drive means for imparting the reciprocating motion to the lower die support member; and control means operably connected to the first and second drive motors and the lower die drive means for controlling these drive motors and the drive means, the control being made in accordance with data inputted in advance into the control means, to thereby generate a relative movement of the first and second rotary members during the forging work, whereby an angle defined by the axis of the die holder that is, the line connecting the centers of the first and second spherical shaft portions and the vertical axis is changed so that a reciprocating motion may be applied in a minute range in the vertical axis direction to the upper die because of the angle change and the provision of the press link.

3. The apparatus according to claim 2, further comprising:

a third motor;

a third rotary member supported rotatably about the vertical axis below the upper machine frame, and formed with a third eccentric hole having a constant eccentric offset relative to a rotary axis of the third rotary member, the third rotary member being drivingly rotated by the third motor;

a fourth drive motor; and a fourth rotary member engaged rotatably with the third eccentric hole, and formed with a fourth eccentric hole having substantially the same eccentric offset as that of the offset of the third rotary member, the fourth rotary member being drivingly rotated by the fourth drive motor, the second bearing member being engaged with the fourth eccentric hole of the fourth rotary member to be rotatable and movable in the axial direction of the vertical axis within a constant range, the control means controlling the first, second, third and fourth motors and the lower die drive means.

4. In a plastic working apparatus including a frame, a first die having a shaping face, and a second die confronting the first die for mounting thereon a workpiece, the workpiece being depressed by co-operation of the first and second die, thereby applying a plastic work to the workpiece, the improvement comprising:

a die holder means having one end connected to the first die;

a link means rotably and inclinably provided between the die holder means and the frame;

moving means for providing swiveling motion to the die holder means about an axis passing through a substantially center portion of the workpiece to form a central projection therein; and changing means for changing an inclination angle of the die holder means.

5. The improvement according to claim 4, wherein the die holder means has another end portion formed with a recess extending in an axial direction thereof, the recess having a bottom rotatably supporting the link means.

6. The improvement according to claim 5, wherein the frame defines a vertical axis, and wherein the link means has one end rotatable about a point on the vertical axis and engageable with the frame, and has another end rotatably supported by the bottom of the recess.

7. The improvement according to claim 6, wherein the moving means comprises;

a first drive motor;

a first rotary member supported to the frame and rotatable about the vertical axis, the first rotary member being formed with a first eccentric hole eccentric with respect to its rotary axis by a predetermined offset, and drivingly rotated by the first drive motor;

a second drive motor; and a second rotary member rotatably engaged with the first eccentric hole, the second rotary member being formed with a second eccentric hole eccentric with respect to its rotary axis by substantially the same offset as that of the first rotary member, and drivingly rotated by the second drive motor, the another end portion of the die holder means being supported by the second eccentric hole.

8. The improvement according to claim 6, further comprising;

a third motor;

a third rotary member supported at a position below the first and second rotary members and rotatable about the vertical axis, the third rotary member being formed with a third eccentric hole having a constant eccentric offset relative to a rotary axis of the third rotary member, the third rotary member being drivingly rotated by the third motor;

a fourth drive motor; and a fourth rotary member engaged rotatably with the third eccentric hole and formed with a fourth eccentric hole having substantially the same eccentric offset as that of the offset of the third rotary member, the fourth rotary member being drivingly rotated by the fourth drive motor, the one end of the die holder means being rotatably supported by the fourth eccentric hole.

9. The improvement according to claim 8, further comprising:

a first bearing member engaged with the second eccentric hole so as to be rotatable and movable in the axial direction, the another end of the die holder means being supported by the second rotary member through the first bearing member; and a second bearing member engaged with the fourth eccentric hole so as to be rotatable and movable in the axial direction, the one end of the die holder means being supported by the fourth rotary member through the second bearing member.

10. The improvement according to claim 9, further comprising;

a second die support member for supporting the second die, the second die support member being supported reciprocally in a vertical direction; and a second die drive means for imparting the reciprocating motion to the second die support member.

11. The improvement according to claim 10 further comprising control means operably connected to the first and second drive motors and the second die drive means, the control being made in accordance with data inputted in advance into the control means, to thereby generate a relative movement of the first and second rotary members during the plastic working.

* * * * *